US007204366B2

(12) United States Patent
Nelms et al.

(10) Patent No.: US 7,204,366 B2
(45) Date of Patent: Apr. 17, 2007

(54) CREDIT CARD CASE WITH QUICK-RELEASE LATCH

(75) Inventors: David W. Nelms, Lake Forest, IL (US); Rodney A. Dawson, Lake Zurich, IL (US)

(73) Assignee: Discover Financial Services LLC, Riverwoods, IL (US)

( * ) Notice: Subject to any disclaimer, the term of this patent is extended or adjusted under 35 U.S.C. 154(b) by 338 days.

(21) Appl. No.: 10/682,008

(22) Filed: Oct. 9, 2003

(65) Prior Publication Data

US 2004/0140231 A1 Jul. 22, 2004

Related U.S. Application Data

(60) Provisional application No. 60/417,545, filed on Oct. 10, 2002.

(51) Int. Cl.
*A45C 11/32* (2006.01)

(52) U.S. Cl. ..... 206/37.4

(58) Field of Classification Search ..... 206/37, 206/37.2, 37.4, 37.5, 37.7, 37.8, 38, 38.1, 206/39; 220/324, 326; 150/147, 149; 24/3.7, 24/3.12, 598.3, 601.6; 70/456 R, 457; 224/269, 224/666, 669, 670, 679

See application file for complete search history.

(56) References Cited

U.S. PATENT DOCUMENTS 736,299 A * 8/1903 Rose ..... 70/456 R
1,063,577 A 6/1913 Moran
2,550,038 A * 4/1951 Brown ..... 59/85
3,242,959 A 3/1966 Glass ..... 150/39
3,606,777 A 9/1971 Watson ..... 70/458
3,650,210 A 3/1972 Archer ..... 101/369
3,838,252 A 9/1974 Hynes et al. ..... 235/61.12 M (Continued)

FOREIGN PATENT DOCUMENTS

DE 3926410 A1 2/1991

(Continued)

OTHER PUBLICATIONS

Wolfgang Rankl, "Handbuch Der Chipkarten: Aufbau, USW", Handbuch Der Chipkarten, Aufbau-Funktionsweise-Einsatz Von Smart Cards, Muenchen: Carl Hanswer Verlag, DE, 1999, pp. 44-47, 56-61, 68-71.

*Primary Examiner*—Shian T. Luong
(74) *Attorney, Agent, or Firm*—Leydig, Voit & Mayer, Ltd.

(57) ABSTRACT

A credit card case or fob with an integrated quick-release latch is provided that may be unclipped readily from a key loop, key chain or other device. The quick-release credit card case includes upper and lower cover portions and a pivot member for connecting the upper and lower cover portions. The pivot member is adapted to have at least one card mounted thereon so as to permit pivotal rotation of the card relative to the upper and lower cover portions. The upper and lower cover portions each have a slot in an outer surface thereof at mateably aligned locations to permit insertion of a key chain loop therein. A latch mounted on at least one of the cover portions is selectively movable to alternate positions exposing the radially outwardly facing opening of the slot in said cover portions and closing said radially outwardly facing opening of the slot in said cover portions.

17 Claims, 4 Drawing Sheets

U.S. PATENT DOCUMENTS

| | | | | |
|---|---|---|---|---|
| 4,100,011 | A | 7/1978 | Foote | 156/272 |
| 4,739,877 | A | 4/1988 | Olson | 206/38.1 |
| 4,765,460 | A * | 8/1988 | Vigueras Pacheco | 206/38.1 |
| 4,829,690 | A | 5/1989 | Andros | 40/642 |
| D302,074 | S | 7/1989 | Halasz | D3/208 |
| D314,865 | S | 2/1991 | Tuisku | D3/56 |
| 5,020,255 | A | 6/1991 | Rodel | 40/654 |
| D322,816 | S | 12/1991 | Immerman | D20/28 |
| D324,305 | S | 3/1992 | Prey | D3/56 |
| 5,217,056 | A | 6/1993 | Ritter | 150/147 |
| 5,477,714 | A | 12/1995 | Bishop | |
| 5,520,230 | A | 5/1996 | Sumner, III | 150/147 |
| D372,358 | S | 8/1996 | Mathison | D3/247 |
| D381,499 | S | 7/1997 | Campbell | D3/212 |
| 5,718,329 | A | 2/1998 | Ippolito et al. | 206/38 |
| D393,150 | S | 4/1998 | Swanston et al. | D3/247 |
| D396,882 | S | 8/1998 | Neal, Jr. | D19/10 |
| D411,765 | S | 7/1999 | Holihan | D3/247 |
| 5,983,686 | A * | 11/1999 | Lee | 70/456 R |
| D419,289 | S | 1/2000 | Edwards | D3/208 |
| 6,011,677 | A | 1/2000 | Rose | 360/133 |
| 6,155,410 | A | 12/2000 | Davis | 206/39.5 |
| D436,991 | S | 1/2001 | Morgante | D19/9 |
| 6,202,933 | B1 | 3/2001 | Poore et al. | 235/493 |
| 6,224,109 | B1 | 5/2001 | Yang | 283/77 |
| 6,248,199 | B1 | 6/2001 | Smulson | 156/244.12 |
| 6,311,884 | B1 * | 11/2001 | Johnson | 224/627 |
| D453,160 | S | 1/2002 | Pentz et al. | D14/436 |
| D453,161 | S | 1/2002 | Pentz | D14/436 |
| D453,336 | S | 2/2002 | Pentz et al. | D14/436 |
| D453,337 | S | 2/2002 | Pentz et al. | D14/436 |
| D453,338 | S | 2/2002 | Pentz et al. | D14/436 |
| D453,339 | S | 2/2002 | Pentz | D14/436 |
| D453,516 | S | 2/2002 | Pentz | D14/436 |
| D453,517 | S | 2/2002 | Pentz | D14/436 |
| D456,814 | S | 5/2002 | Pentz | D14/436 |
| D460,454 | S | 7/2002 | Pentz | D14/436 |
| D460,455 | S | 7/2002 | Pentz | D14/436 |
| D462,965 | S | 9/2002 | Pentz | D14/436 |
| D462,966 | S | 9/2002 | Pentz et al. | D14/436 |
| D470,657 | S | 2/2003 | Kawamura | D3/247 |
| 6,513,349 | B1 * | 2/2003 | Miao | 70/57 |
| D474,234 | S | 5/2003 | Nelms et al. | D19/9 |
| 2001/0038033 | A1 | 11/2001 | Habib | 235/375 |
| 2002/0027837 | A1 | 3/2002 | Weber | 369/14 |
| 2002/0092914 | A1 | 7/2002 | Pentz et al. | 235/487 |

FOREIGN PATENT DOCUMENTS

| | | | |
|---|---|---|---|
| DE | 298 02 638 | U1 | 6/1998 |
| DE | 298 12 046 | U1 | 11/1998 |
| EP | 0 379 921 | A2 | 8/1990 |
| EP | 1 221 518 | A2 | 7/2002 |
| FR | 2 794 059 | | 12/2000 |
| JP | 2000-113136 | A1 | 4/2000 |
| WO | WO 02/067190 | A2 | 8/2002 |

* cited by examiner

CREDIT CARD CASE WITH QUICK-RELEASE LATCH

RELATED APPLICATIONS

This application is related to and claims the priority of U.S. Provisional Application No. 60/417,545 filed Oct. 10, 2002, the contents of which are herein incorporated by reference.

BACKGROUND OF THE INVENTION

The present invention relates to a case, fob or article for holding one or more credit cards, special value cards or other payment instrument, and particularly to a credit card case or fob that contains an integrated quick-release latch that may be unclipped readily from a key chain.

Suppliers of conventional credit cards and special value cards desire to have their particular card carried by the user in an accessible position outside of a wallet or a purse, for example on a key loop, key chain, or in a packet on a readily accessible device in order to increase the likelihood of usage of the card. The advantage of having the card accessible outside of a wallet or purse is that the user has the card available at his or her fingertips instead of having to open a purse or wallet and make a choice to use a particular card or payment instrument from among several possible choices.

In order to protect credit cards from theft of the card itself or the card number when the card is carried on a key chain, cases or fobs have been developed for concealing the card. The person using the card normally opens the case, container or fob without unclipping it from the key chain in order to pivot the card to an accessible position so that the card may be swiped through a magnetic card reader or, a radio frequency reader or other identification system. There are occasions, however, when, in order to use the card, the case or container must be removed from the key chain. For example, it may be necessary to unclip the case from the chain in order to access the case for use at a fast food drive-in when a key on the chain is in the ignition of a car. Prior key chain cases typically require stopping the car engine, removing the key from the ignition, and using two hands to remove the case or container from the key chain. There is a need therefore to provide a credit card case with an integrated quick-release latch that can be more easily removed from a key chain in order to gain access to the case or to the credit card.

SUMMARY OF THE INVENTION

The present invention provides a credit card case that with an integrated quick-release latch may be unclipped readily from a key loop or key chain.

In one embodiment the quick-release credit card case includes upper and lower cover portions and a pivot member for connecting the upper and lower cover portions. The pivot member is adapted to have at least one card mounted thereon so as to permit pivotal rotation of the card relative to the upper and lower cover portions. The upper and lower cover portions each have a slot in an outer surface thereof that can be aligned and mated to permit insertion of a key chain loop therein. A latch mounted on at least one of the upper and lower cover portions is selectively movable to alternate positions. In a first position, the latch exposes a radially outwardly facing opening of the slot in said upper and lower cover portions. In a second position, the latch closes or covers the radially outwardly facing opening of the slot.

Preferably the latch includes a flexible spring-like portion for biasing the latch into a normally closed position covering the radially outwardly facing opening of the slot. Most preferably the latch is slidably mounted on a track formed on an outer peripheral surface of one of the cover portions and the flexible spring-like portion of the latch comprises an extension engaging a flange on said one of the cover portions. The quick-release credit card case, container or fob of the invention may be removed by using one hand from a key chain or key loop or from whatever item to which the case is attached, such as a belt loop, laptop computer case, clothing, purse, brief case, or personal digital assistant case. A person is able to grasp the case of the invention with one hand and move the quick-release latch to an open position by movement of the thumb of that hand without using their other hand at all.

DETAILED DESCRIPTION OF THE PREFERRED EMBODIMENTS

The present invention provides a credit card case with an integrated quick-release latch which may be unclipped readily from a key loop, key chain, or other item.

Figure 1:
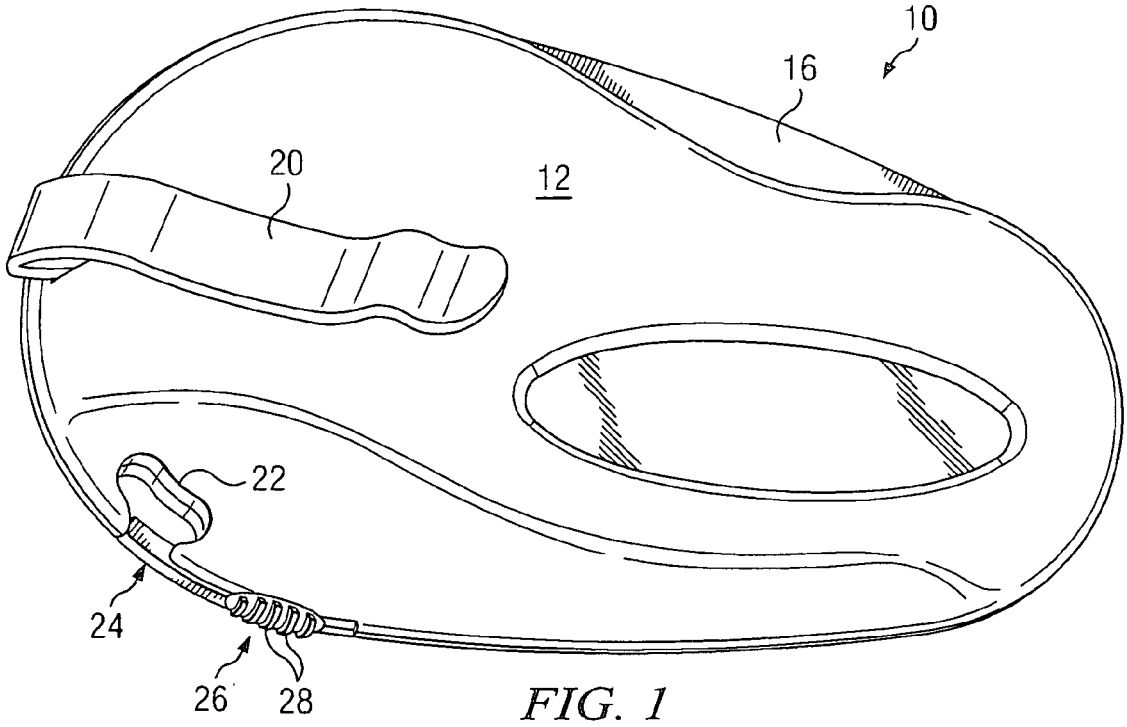
FIG. 1 are a perspective view of one side of the quick-release credit card case of the present invention.
Figure 2:
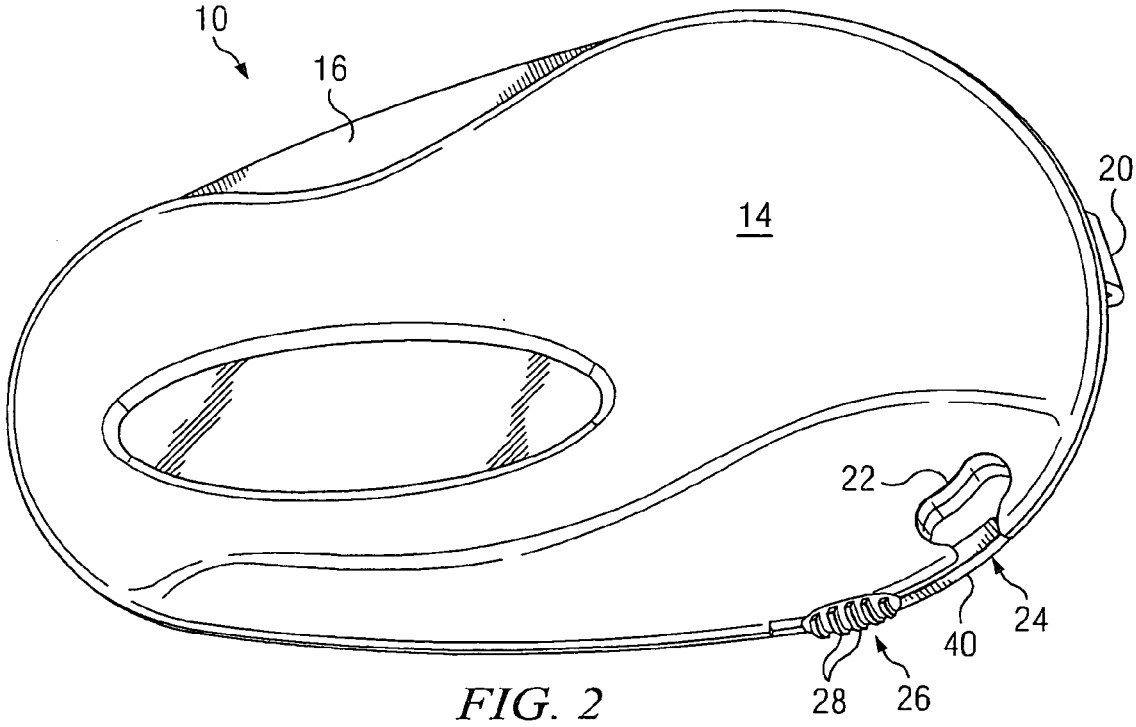
FIG. 2 are a perspective view of the reverse side of the quick release credit card case of FIG. 1.
Figure 3:
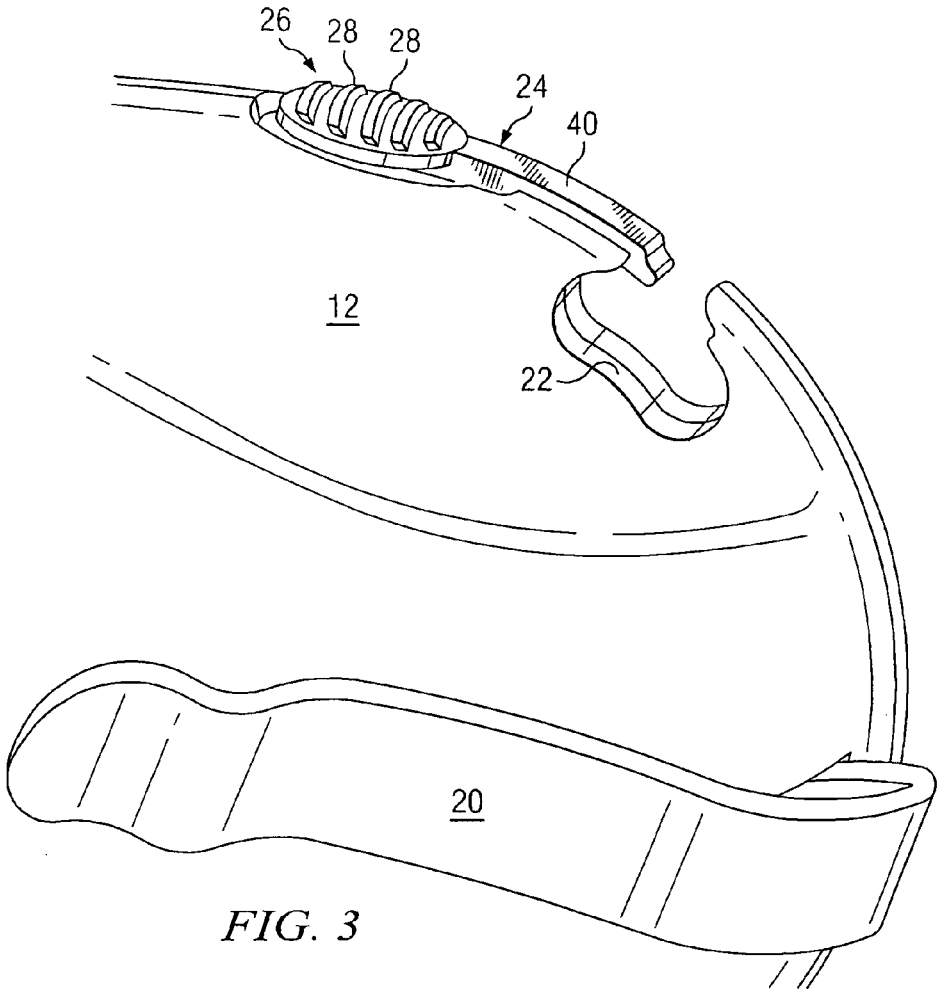
FIG. 3 are a perspective view similar to FIG. 2 showing the latch in an open position exposing a key chain slot in the case.

FIGS. 1 and 2 show quick-release credit card case 10 having an upper cover portion 12 (FIG. 1) and a lower cover portion 14 (FIG. 2). Credit card 16 is pivotally mounted in case 10 on a pivot member. Card 16 partially extends beyond the outer periphery of the case so as to permit the card to be grasped by a person's thumb and forefinger and pivoted to an exposed position downwardly of the case in FIG. 1 and upwardly in FIG. 2 (not illustrated in either Figure). The pivot member may be a rivet or post as known in the art. Preferably the card is detachable from the pivot member in order to be fully removed from the case. This may be accomplished by providing a knurled opening in the card, said opening having an open end for the pivot connection to the pivot member. A description of a card having such an opening and pivotal connection is set forth in PCT/US Application Serial No. PCT/US02/22,933, entitled "Credit Card With Case" filed Jul. 17, 2002, the entire specification of which is incorporated herein by reference. A clip 20 is preferably provided for holding currency, a driver's license or attaching the case to other items against upper cover portion 12. Slot or aperture 22 is provided in upper and lower cover portions 12 and 14 to permit passage of a key chain loop. Preferably slot 22 is of arc shape having a substantially circular inner surface. Latch 24 is provided for alternately exposing and closing a radially outwardly facing opening (FIG. 3) of slot 22. Latch 24 is shown in closed position covering the radially outwardly facing opening of slot 22 in FIGS. 1 and 2 and in the retracted open position exposing said opening in FIG. 3. Latch 24 preferably has a thumb pad 26 with a plurality of ridges 28 on an outer surface of the pad to provide friction when engaged by the thumb or finger of a person's hand in order to permit ease of movement of the latch.

Figure 4:
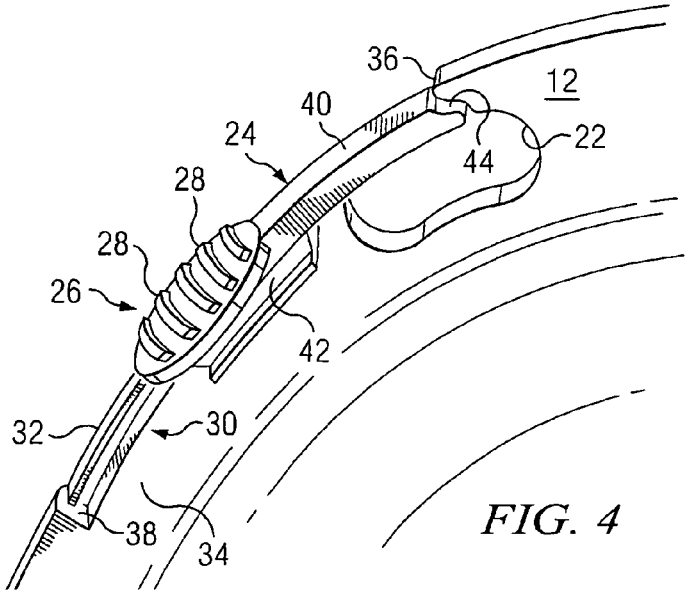
FIG. 4 are a partial perspective view of the interior surface of the upper cover showing the latch mounted on a track of the upper cover with the latch in closed position covering the slot opening.
Figure 5:
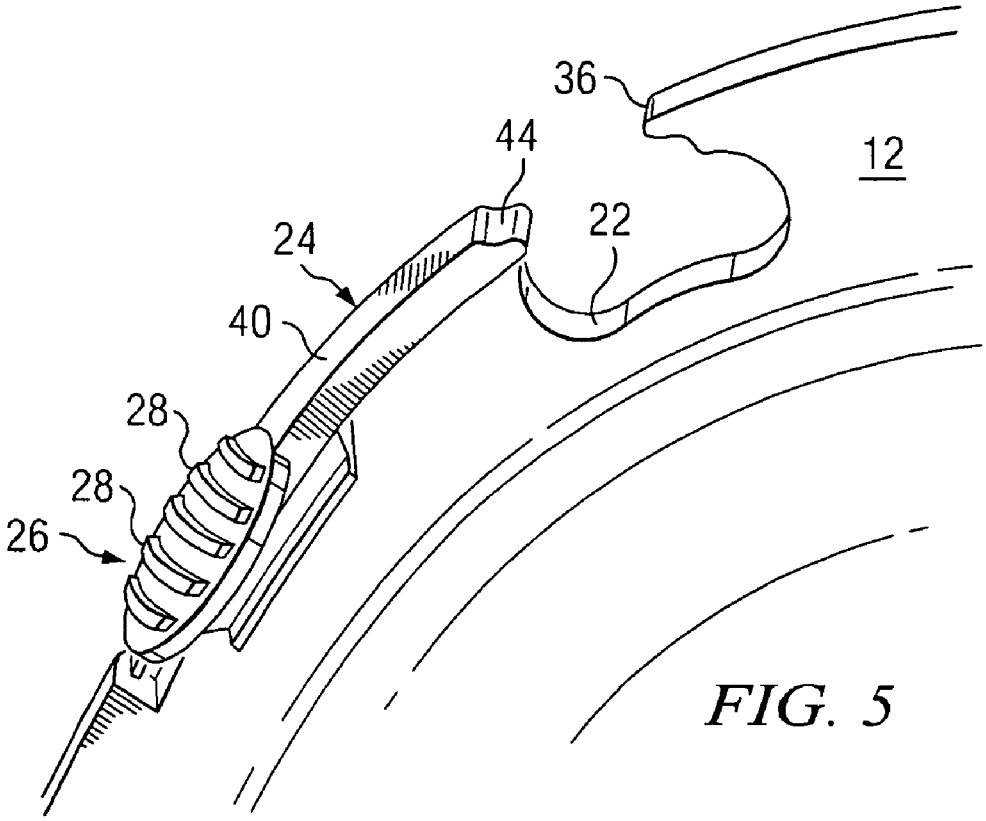
FIG. 5 are a partial perspective view similar to FIG. 4 showing the latch in the open position.

Referring to FIGS. 4 and 5, upper cover portion 12 has a track or rail 30 comprising a flat head section 32 and a web section 34 extending lengthwise from an edge of slot 22 along a portion of the outer periphery of cover portion 12. Other track or rail configurations may be used such as spaced parallel tracks on either the latch or the cover portion that receive a flange of the cover portion or latch to ride between the tracks. Cover portion 12 has a curved stop surface 36 on an opposite edge of slot 22 from track or rail 30. Cover portion 12 also has a stop surface 38 at the end of track 30. Stop surfaces 36 and 38 serve to limit the extent of slidable movement of latch 24 on track 30 to its respective open and closed positions. Latch 24 has a longitudinal flat head portion 40 and a web portion 42 for riding slidably on flat head section 32 and web section 34 of track 30. Latch 24 has a curved surface 44 at one end for engagement with curved stop surface 36 on the edge of slot 22.

Figure 6:
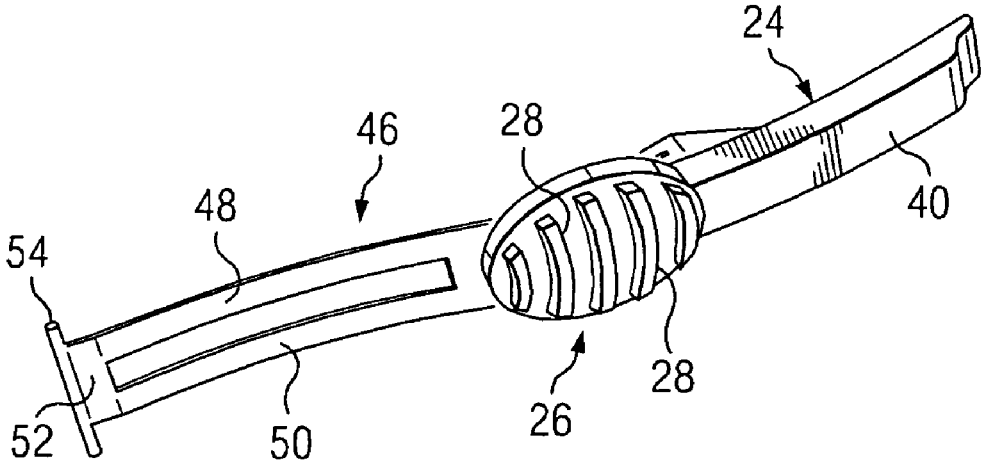
FIG. 6 are a perspective view of the latch showing a flexible spring-like tail section of the latch.
Figure 7:
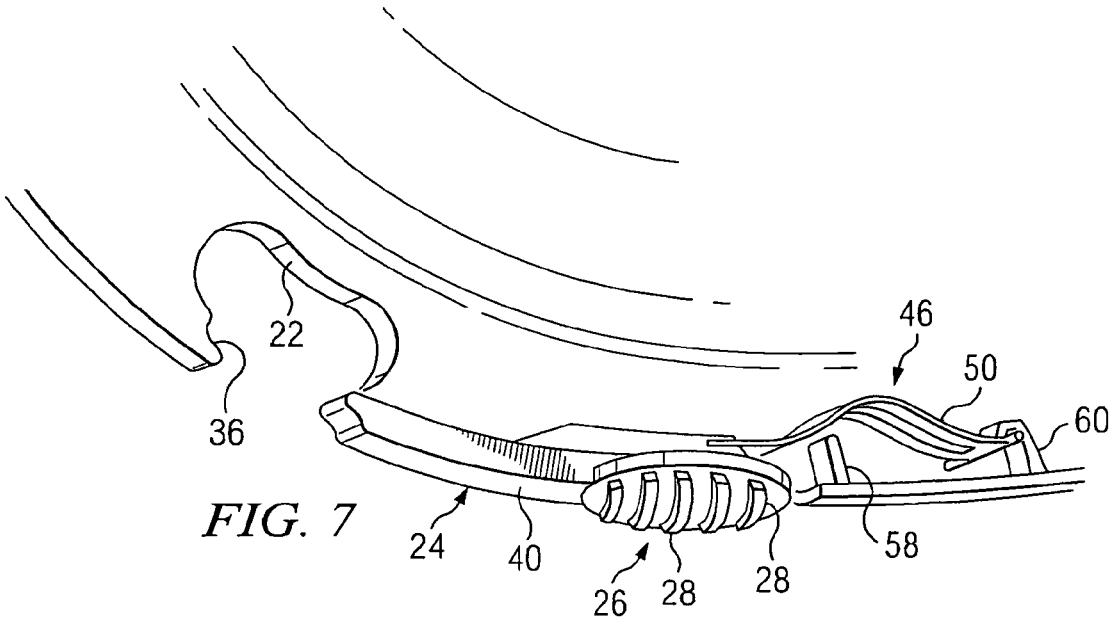
FIG. 7 are a partial view of the interior of the upper cover showing the latch in open position with the end of the flexible spring-like tail section of the latch abutted against a flange in the upper cover.

Referring to FIGS. 6 and 7, latch 24 has a flexible spring-like tail section 46 comprising two lengthwise extending portions 48 and 50 that are joined at their outer ends by flat portion 52. Pin section 54 extends transversely of flat portion 52 for engagement in angular flange 56 (FIG. 7) of cover portion 12. Radial flanges 58 and 60 guide tail section 46 when latch 24 is slidably moved back and forth to alternate open and closed positions. Latch 24 is preferably comprised of plastic material having both strength and flexibility with memory properties providing spring-like characteristics in flexible tail section 46. Preferably tail section 46 is molded so as to be an integral part of latch 24 although that is not required. The tail may be a separate section attached to latch 24 or engageable with latch 24.

Figure 8:
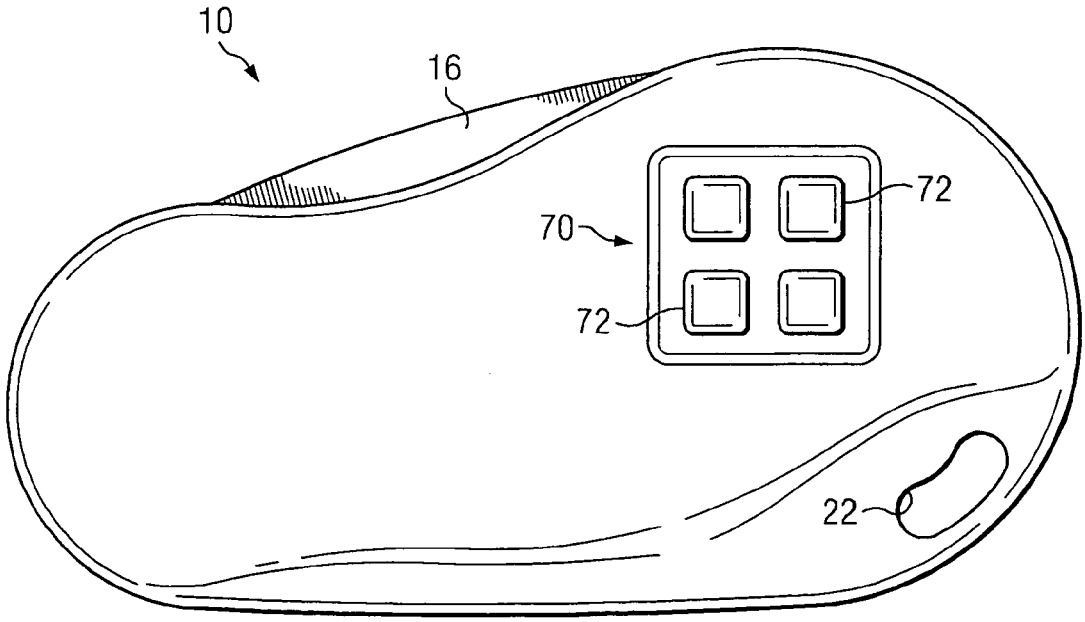
FIG. 8 is a top perspective view of an alternative embodiment.

Referring to FIG. 8, an alternative embodiment of the case 10 with credit card 16 and aperture 22. A key pad 70 is included in the top of the case with one or more keys 72 located on the pad. Presently, many automobile users have a fob or other device that hangs from their keys and includes a key pad with keys for remote access to the automobile. These remote access keys include the ability to, for example, unlock car doors, open or roll-down windows, unlatch a trunk, or activate a garage door opener or other key-less entry device. The embodiment of FIG. 8 contemplates inclusion of the standard keypad with automobile remote access keys onto the case for the card, along with the associated electronics needed to operate the remote access keys. With this embodiment, the user avoids needing a second key fob for maintaining automobile remote access devices, which are combined with the credit card case.

While a preferred embodiment of the invention has been identified, other configurations and modifications can be provided within the scope of the present invention. For example, it is conceivable that only one cover portion may be required depending on the type of card to be carried in the case, it being necessary to protect only the surface of the card containing the card number and other identification information or means. It is also conceivable that a single integral cover could be provided for covering both sides of the card rather than separate upper and lower cover portions. Other configurations of quick release means could also be provided. For example, a rotatable latch could be provided that would rotate in a plane parallel to one of the cover portions in order to alternately expose and close the slot opening.

We claim:

1. A case having a slot in the periphery of the case, comprising:

a stop surface positioned on a first side of the slot;

a latch slidably attached on a second side of the slot, the second side being opposed to the first side, the latch comprising:

a main section having an extension; and a tail section;

a flange for receiving the tail section, wherein the tail section provides a spring function that biases the extension of the latch to contact with stop surface; and a rail, wherein the latch engages the rail.

2. A case as in claim 1 wherein the latch is integrally formed.

3. A case as in claim 1 wherein the tail section comprises a flat member that provides the spring function by flexing when compressed against the flange.

4. A case as in claim 1 wherein the latch is plastic.

5. A case as in claim 1 wherein the tail section comprises two lengthwise extending portions that are joined at the outer ends of the extending portions by a flat portion.

6. A case as in claim 5 wherein the flat portion includes a pin section for engagement with the flange.

7. A case as in claim 1 wherein the case encases a credit card device.

8. A case as in claim 1 wherein the latch further includes a thumb pad having a plurality of ridges.

9. A case having a slot in the periphery of the case, comprising:

a stop surface positioned on a first side of the slot;

a plastic latch slidably attached on a second side of the slot, the second side being opposed to the first side, the latch comprising:

a main section having an extension;

a thumb pad having a plurality of ridges; and a tail section including two lengthwise extending portions that are joined at the outer ends of the extending portions by a flat portion having a pin portion;

a flange for receiving the pin portion of the tail section, wherein the tail section provides a spring function that biases the extension of the latch to contact with said stop surface.

10. A method for forming a latch in a case, comprising:

providing a stop surface positioned on a first side of a slot in the periphery of the case;

slidably attaching a latch on a second side of the slot, the second side being opposed to the first side, the latch comprising:

a main section having an extension; and a tail section;

providing a flange for receiving the tail section, wherein the tail section provides a spring function that biases the extension of the latch to contact with stop surface; and providing a rail, wherein the latch engages the rail.

11. A method as in claim 10 wherein the latch is integrally formed.

12. A method as in claim 10 wherein the tail section comprises a flat member that provides the spring function by flexing when compressed against the flange.

13. A method as in claim 10 wherein the latch is plastic.

14. A method as in claim 10 wherein the tail section comprises two lengthwise extending portions that are joined at the outer ends of the extending portions by a flat portion.

15. A method as in claim 14 wherein the flat portion includes a pin section for engagement with the flange.

16. A method as in claim 10 wherein the case encases a credit card device.

17. A method as in claim 10 wherein the latch further includes a thumb pad having a plurality of ridges.

* * * * *